US006459057B1

(12) United States Patent
Domzalski

(10) Patent No.: US 6,459,057 B1
(45) Date of Patent: Oct. 1, 2002

(54) SEALED PUSHBUTTON SWITCH

(75) Inventor: Frank Mark Domzalski, Wellesley, MA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 09/712,609

(22) Filed: Nov. 13, 2000

(51) Int. Cl.[7] ..... H01H 13/06
(52) U.S. Cl. ..... 200/302.2
(58) Field of Search ..... 200/520, 530, 200/531, 532, 302.1, 302.2, 341

(56) References Cited

U.S. PATENT DOCUMENTS 2,748,229 A 5/1956 Block ..... 200/169
3,914,570 A * 10/1975 Lockard ..... 200/153 J
3,983,354 A 9/1976 Gammie et al. ..... 200/43.08
4,430,532 A * 2/1984 Matsumoto ..... 200/52 R
4,877,930 A * 10/1989 Fukuma ..... 200/302.2
5,389,758 A 2/1995 Agnatovech ..... 200/530
5,828,024 A * 10/1998 Takano et al. ..... 200/531
5,836,442 A * 11/1998 Hirano ..... 200/284
5,990,430 A * 11/1999 Shiau ..... 200/302.2

* cited by examiner

*Primary Examiner*—Michael Friedhofer
(74) *Attorney, Agent, or Firm*—Pearson & Pearson, LLP

(57) ABSTRACT

A sealed, pushbutton, single pole, normally closed switch for soldering to a printed circuit board. The switch operates by pushing an actuator that compresses a spring and breaks continuity between two terminals by moving a spring contact, disposed in the head of the actuator, away from the terminals. An O-ring is provided in an annular groove around a shaft of the actuator for sealing the switch between the actuator and a cover without significantly changing the actuator force, and the bottom of the switch has an epoxy seal. The method of assembling the sealed switch components is simple and low cost.

13 Claims, 6 Drawing Sheets

SEALED PUSHBUTTON SWITCH

BACKGROUND OF THE INVENTION

1. Field of the Invention

The present invention relates to sealed pushbutton switches for use on printed circuit boards, and in particular to a single pole, normally closed switch having an O-ring that prevents leaks between an actuator and cover of the switch without significantly changing the actuation force, and having an epoxy sealed base.

2. Description of Related Art

Pushbutton switches that are soldered into printed circuit boards can be contaminated after going through soldering precesses and cleaning processes. If an external seal is provided, the manufacturer must remove the seal after processing. External seals add material and labor costs.

O-rings have been used with switches, for example, to keep a switch water tight. The following U.S. Patents disclose the use of O-rings in switches:

U.S. Pat. No. 2,748,229 issued to Edwin H. Block on May 29, 1954 and assigned to the United States of America discloses a cam operated water tight switch operated by depressing a plunger. In order to insure a water tight connection between casing and wall, a ring of solder is heat sealed in grooves and in the casing. The switch comprises the plunger having a pushbutton slidably mounted in a bore. An O-ring gasket is mounted in a groove of the plunger for preventing ingress of water to the interior of the switch casing. The plunger has a threaded extension and a tubular member and a hollow cylindrical plug. A pair of micro switches, having operating pins are operated by spring arms extending from a member having a cam surface when the plunger is moved inwardly. A spring returns tubular member to the initial position and springs are released by cam surfaces. However, this invention uses an O-ring in a manner that significantly affects actuation force.

U.S. Pat. No. 3,983,354 issued Sep. 28, 1976 to Joseph E. Gammie et al. and assigned to General Motors Corporation discloses a rotary switch comprising a housing, a cover, three stationary contacts, a rotor, an O-ring seal and a combination sealing and driving member. The switch is used to arm and disarm an automobile anti-theft system in response to operation of the door lock key. However, this invention also uses an O-ring in a manner that significantly affects actuation force.

U.S. Pat. No. 5,389,758, issued Feb. 14, 1995 to William J. Agnatovech and assigned to Augat, Inc. discloses a miniature pushbutton switch manufactured of molded, resilient parts that are snap-fitted together. The switch comprises a platform assembly, a pushbutton assembly and an encasement assembly. No tools are required to assemble the switch and glue or epoxy may be used to seal the switch. The pushbutton assembly comprises a pushbutton actuator, a bias element or spring 52 and a slider block having at least one electrical shorting element disposed therein and in electrical contact with one set of contacts. However, this invention does not have an O-ring seal.

SUMMARY OF THE INVENTION

Accordingly, it is therefore an object of this invention to provide a sealed pushbutton switch with terminals for soldering onto a printed circuit board.

It is another object of this invention to provide a pushbutton switch that is sealed and suitable for undergoing soldering processes and cleaning processes.

It is a further object of this invention to provide a sealed single pole, normally closed pushbutton switch having an epoxy seal on the bottom of the switch.

It is another object of this invention to provide a sealed pushbutton switch having an O-ring on an actuator to prevent leaks between the actuator and a cover of the switch without changing the actuation force.

It is another object of this invention to provide a sealed pushbutton switch that is easily and quickly assembled at low cost.

These and other objects are accomplished by a sealed pushbutton switch comprising a cover having an opening in one side of the cover, an actuator having a shaft portion and a head portion, the shaft portion extending through the opening in the side of the cover, the shaft having an annular groove adjacent to the head portion, means positioned between the head portion of the actuator and a side of the cover opposite the side with the opening for maintaining the actuator in a normally closed position, means disposed in the annular recess of the actuator for making a seal between the actuator and the cover, a base having first and second terminals inserted into channels on opposite sides of the base, a contact spring disposed within the head portion of the actuator, a first end and a second end of the contact spring contacting a top portion of the first and second terminals in the base, when the pushbutton switch is in a normally closed position, the cover being attached to the base, and means for sealing a bottom surface of the base adjacent to the cover and the terminals extending from the bottom of the base. The means for maintaining the actuator in a normally closed position comprises a spring. The means disposed in the annular recess for making a seal comprises an O-ring. The means for sealing a bottom surface of the base comprises an epoxy. The epoxy seals between the base and the cover and around the terminals extending from the base.

The objects are further accomplished by a method of providing a sealed pushbutton switch comprising the steps of providing a cover having an opening in one side of the cover, extending through the opening in the side of the cover, an actuator having a shaft portion and a head portion, the shaft portion having an annular groove adjacent to the head portion, maintaining the actuator in a normally closed position with means positioned between the head portion of the actuator and a side of the cover opposite the side with the opening, making a seal between the actuator and the cover with means disposed in the annular groove of the actuator, providing a base having first and second terminals inserted into channels on opposite sides of the base, disposing a contact spring within the head portion of the actuator, a first end and a second end of the contact spring contacting a top portion of the first and second terminals in the base, when the pushbutton switch is in a normally closed position, attaching the cover to the base, and sealing a bottom surface of the base adjacent to the cover and the terminals extending from the bottom of the base. The step of maintaining the actuator in a normally closed position comprises the step of providing a spring positioned between the head portion of the actuator and a side of the cover. The step of making a seal between the actuator and the cover comprises the step of providing an O-ring within the annular groove. The step of sealing a bottom surface of the base comprises the step of using an epoxy to accomplish the sealing. The step of using the epoxy comprises the step of placing the epoxy between the base and the cover and around the terminals extending from the base.

Additional objects, features and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

FIG. 6B is a bottom perspective view of the switch cover showing an area for making the switch and a hole in a side of the cover for the actuator to extend through;

DESCRIPTION OF ILLUSTRATIVE EMBODIMENT

Figure 1:
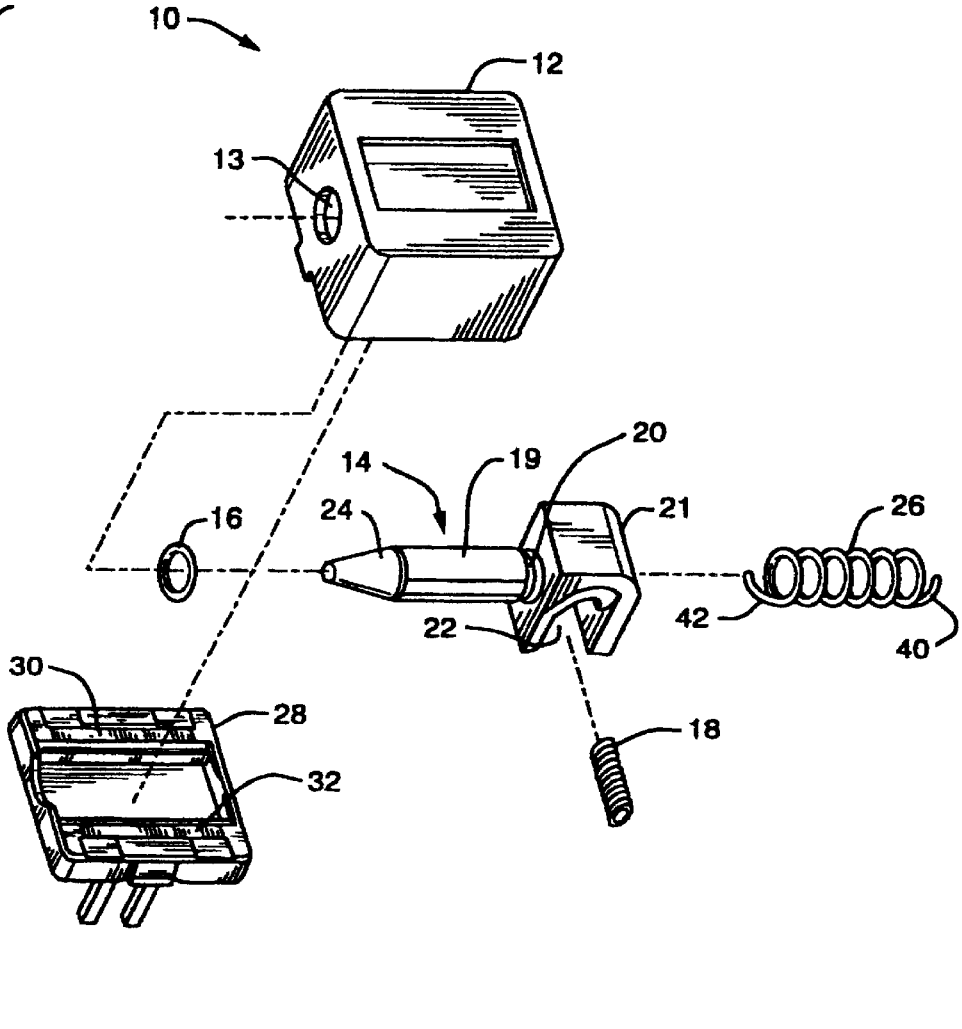
FIG. 1 is an exploded perspective view of a sealed pushbutton switch.
Figure 2:
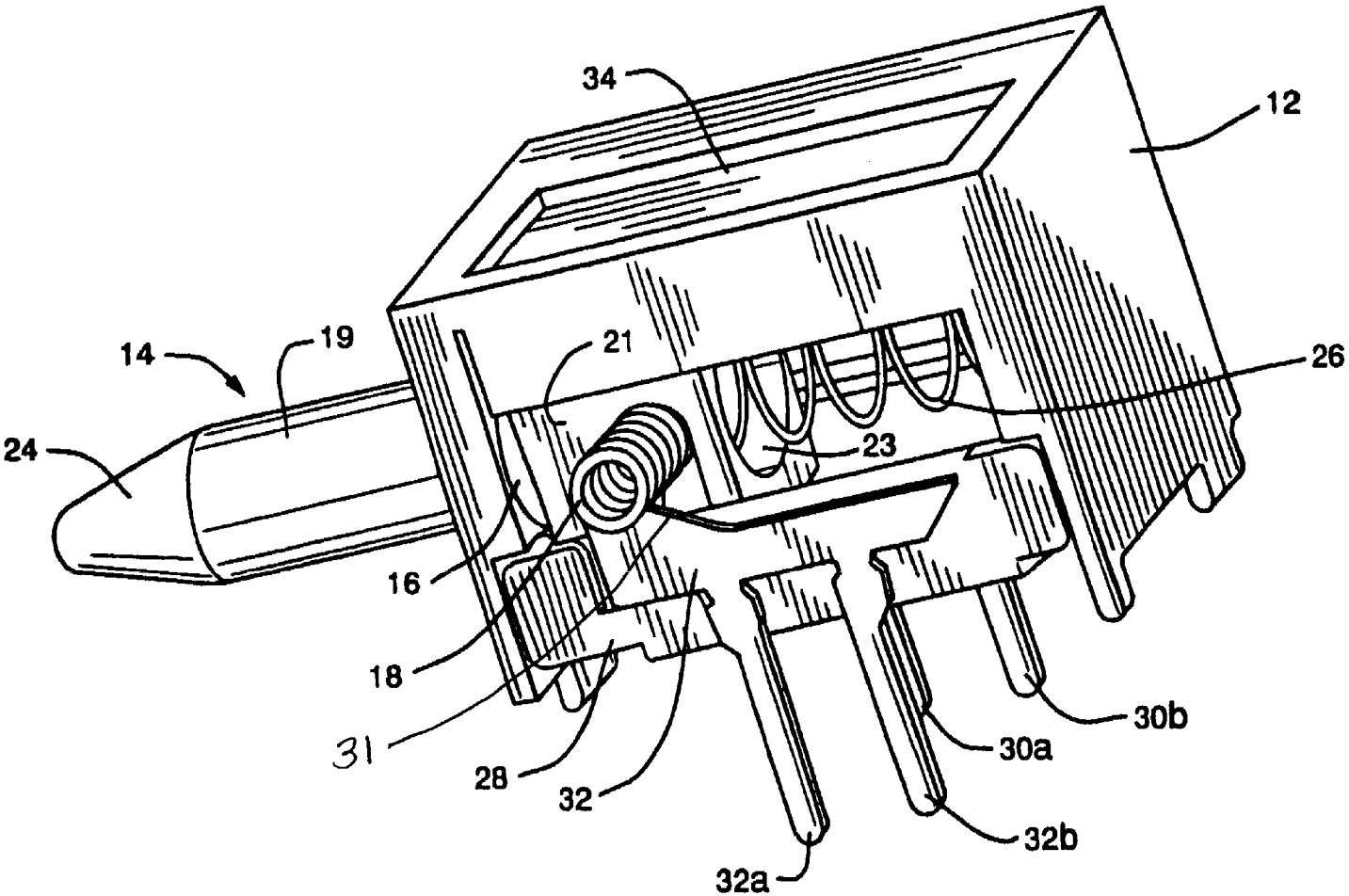
FIG. 2 is a sectional perspective view of the sealed pushbutton switch showing an O-ring adjacent to the head of the actuator, the spring disposed in the head of the actuator and a first end of a contact spring in contact with a first pair of switch contacts.

Referring to FIG. 1 and FIG. 2, FIG. 1 shows an exploded perspective view of a sealed pushbutton switch 10 and FIG. 2 is a sectional perspective view of the sealed pushbutton switch 10 showing the components of FIG. 1 in their normal locations within the pushbutton switch 10. The pushbutton switch 10 functions as a single pole, normally closed switch 10 comprising a cover 12 which snaps onto a base 28. An actuator 14 extends through a hole 13 in the side of the cover 12 and it is inserted in hole 13 from inside the cover 12 during assembly. This is an important feature and results in no seams in the side of the cover 12.

Still referring to FIG. 1 and FIG. 2, an actuator spring 26 has a first end 40 disposed against an inside side wall of the cover 12 and the second end 42 abuts the head 21 of the actuator 14. Spring 26 is a music wire compression spring with sufficient force to push the contact spring 18 up the ramp 31 on terminals 30, 32 and compress O-ring 16. Spring 18 is a tightly wound compression spring with gold or silver plating. Spring 18 has sufficient flex to provide contact force with terminals 30, 32. The head 21 has a recessed area into which the second end 42 of the spring is disposed. The actuator 14 comprises an annular groove 20 around the top of the shaft 19 adjacent to the head 21 of the actuator 14. An O-ring 16 prevents leaks between the actuator 14 and cover 12.

Figure 5A:
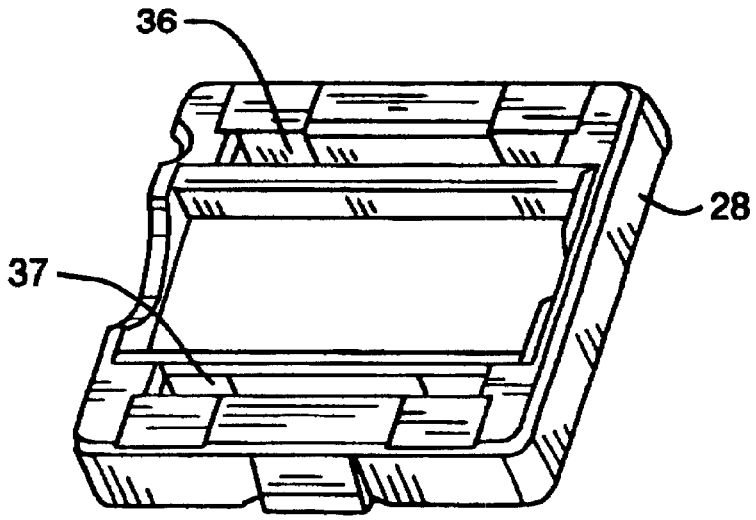
FIG. 5A is a top perspective view of the switch base showing rectangular channels on opposite sides for receiving terminals.
Figure 5B:
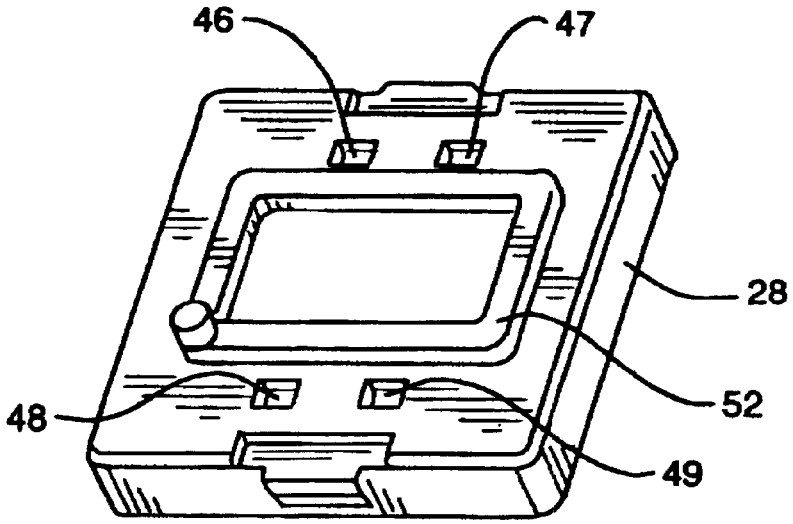
FIG. 5B is a bottom perspective view of the switch base showing a pair of holes on opposite sides for receiving terminal extensions.
Figure 5C:
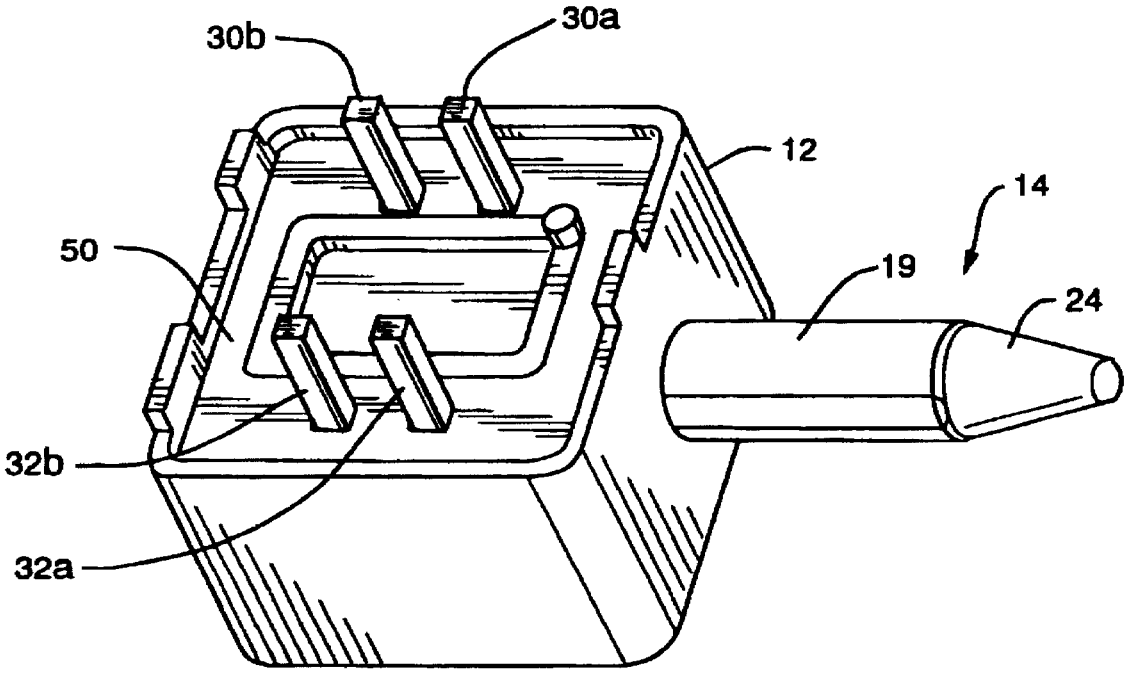
FIG. 5C is a bottom perspective view of the sealed pushbutton switch showing an epoxy seal on the base which provides a seal with the cover and around the terminal extensions.
Figure 6A:
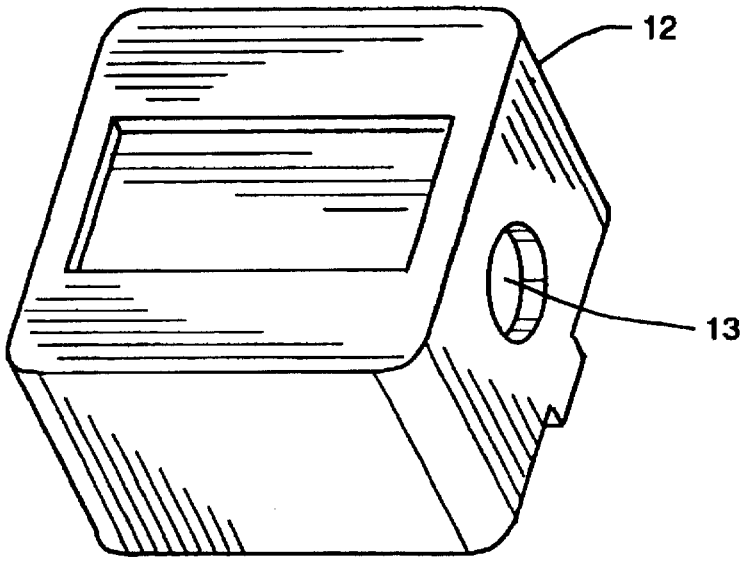
FIG. 6A is a top perspective view of a switch cover showing the opening in a side for insertion of the shaft of the actuator.
Figure 6B:
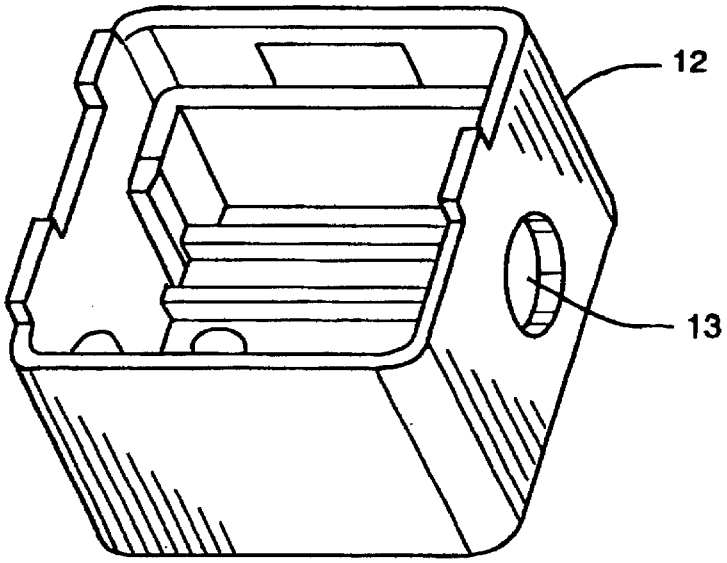

Referring to FIG. 1, FIG. 2, FIG. 5A, and FIG. 5B, FIG. 5A is a top perspective view of the switch base 28 showing rectangular channels 36, 37 on opposite sides of the base 28 for receiving terminals 30, 32. FIG. 5B shows a bottom perspective view of the switch base having a pair of holes 46, 47 and 48, 49 on opposite sides of the base 28. Each of the terminals 30, 32 comprises a pair of terminal extensions 30*a,* 30*b* and 32*b,* 32*b* respectively. Each of the terminals 30, 32 is inserted into the channels 36, 37, respectively, and the terminal extensions 30*a,* 30*b,* and 32*a,* 32*b* extend through holes 46 to 49 in the channels 36, 37 and protrude from the bottom of the base. The terminal extensions 30*a,* 30*b* and 32*a,* 32*b* are used for attaching the switch 10 to a printed circuit board (PCB) via a soldering process.

Referring again to FIG. 1 and FIG. 2, a contact spring 18 is inserted through the head 21 of the actuator 14 and makes electrical contact with terminals 30 and 32 mounted in the base 28 when the actuator 14 is in the normally closed position. When the actuator 14 is pushed the head 21 of the actuator 14 moves the contact spring 18 away from the terminals 30, 32 thereby breaking the electrical contact between terminals 30 and 32. The switch 10 is used in an electronic device where it is desired to know the position of an item that depresses the actuator 14.

Figure 3:
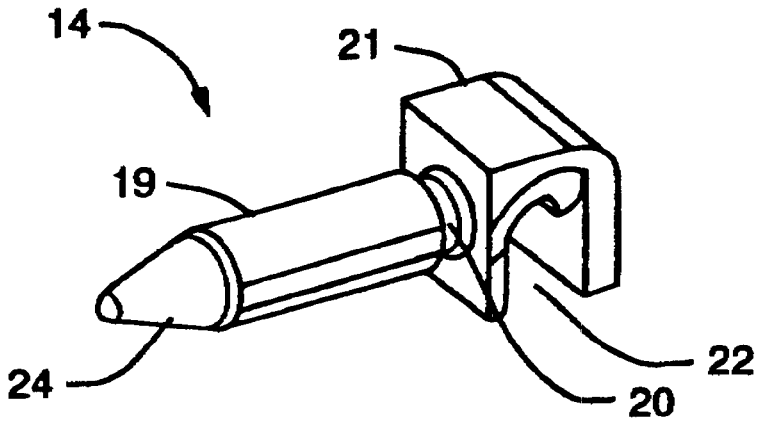
FIG. 3 is a front perspective view of an actuator showing an annular groove for receiving an O-ring.
Figure 4:
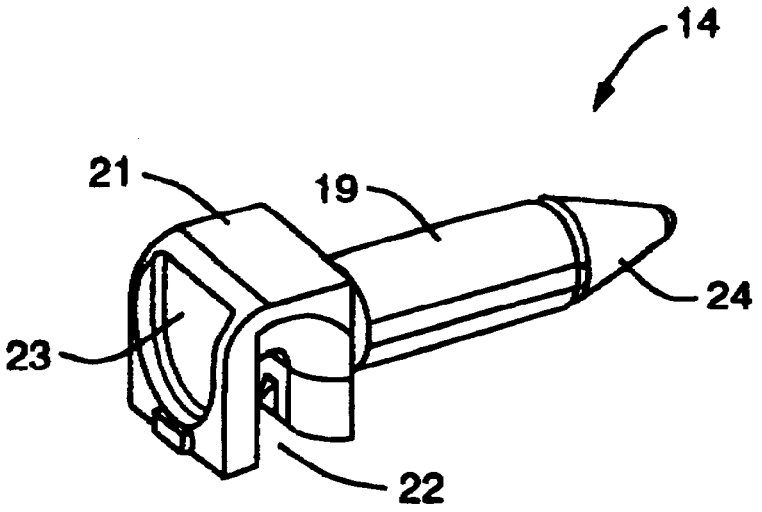
FIG. 4 is a rear perspective view of the actuator showing a recessed area on the head of the actuator for receiving an end of a spring.

Referring to FIG. 3 and FIG. 4, FIG. 3 is a front perspective view of the actuator 14 showing the annular groove 20 around the shaft 19 of the actuator 14 adjacent to the head 21. The end 24 of the shaft 19 has a conical shape which facilitates the insertion of the actuator 14 into the hole 13 on the sides of the cover 12 during assembly. FIG. 4 is a rear perspective view of the actuator 14 showing a recessed area 23 on the end of the head 21 for receiving an end 42 of the spring 26.

Referring to FIG. 2 and FIG. 5B, when the switch 10 is soldered to a PCB, the switch 10 goes through a soldering process and cleaning process. Often switches are contaminated during such manufacturing processes. If an external seal is provided, the manufacturer will remove the seal after the soldering process which adds material and labor costs. However, switch 10 comprises the O-ring 16 that prevents leaks between the actuator 14 and the cover 12. The bottom of the base 28 has an epoxy seal 50 in the area where the terminal extensions 30*a,* 30*b,* 32*a,* 32*b* protrude on opposite sides of the center section 52 of the base 28.

Referring again to FIG. 1 and FIG. 2, the sealed pushbutton switch 10 is constructed to be easily assembled for low cost. As previously described, the actuator and O-ring 14 are inserted into the hole 13 in the side of the cover 12. The spring 26 is added between the head 21 of the actuator 14 and a side wall of the cover 12. The contact spring 18 is inserted into the head 21 of the actuator 14. Terminals 30, 32 are pressed into the base 28 and the base 28 is snapped into the cover 12.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed as new and desired to be secured by Letters Patent of the United States is:

1. A sealed pushbutton switch comprising:

a cover having an opening in one side of said cover;

an actuator having a shaft portion and a head portion, said shaft portion extending through said opening in said side of said cover, said shaft having an annular groove adjacent to said head portion;

means positioned between said head portion of said actuator and a side of said cover opposite said side with said opening for maintaining said actuator in a normally closed position;

means disposed in said annular groove of said actuator for making a seal between said actuator and said cover when said actuator is in a normally closed position, said seal being opened when said actuator is moved into said cover causing said switch to be in an electrically opened position;

a base having first and second terminals inserted into channels on opposite sides of said base;

a contact spring disposed within said head portion of said actuator, a first end and a second end of said contact spring contacting a top portion of said first and second terminals in said base, when said actuator of said pushbutton switch is in said normally closed position;

said cover being attached to said base; and means for sealing a bottom surface of said base adjacent to said cover and said terminals extending from the bottom of said base.

2. The sealed pushbutton switch as recited in claim 1 wherein said means for maintaining said actuator in a normally closed position comprises a spring.

3. The sealed pushbutton switch as recited in claim 1 wherein said means disposed in said annular groove for making a seal comprises an O-ring.

4. The sealed pushbutton switch as recited in claim 1 wherein said means for sealing a bottom surface of said base comprises an epoxy.

5. The sealed pushbutton switch as recited in claim 4 wherein said epoxy seals between said base and said cover and around said terminals extending from said base.

6. A method of providing a sealed pushbutton switch comprising the steps of:

providing a cover having an opening in one side of said cover;

extending through said opening in said side of said cover, an actuator having a shaft portion and a head portion, said shaft portion having an annular groove adjacent to said head portion;

maintaining said actuator in a normally closed position with means positioned between said head portion of said actuator and a side of said cover opposite said side with said opening;

making a seal between said actuator and said cover with means disposed in said annular groove of said actuator when said actuator is in a normally closed position;

braking said seal between said actuator and said cover when said actuator is moved into said cover causing said switch to enter an electrically opened position;

providing a base having first and second terminals inserted into channels on opposite sides of said base;

disposing a contact spring within said head portion of said actuator, a first end and a second end of said contact spring contacting a top portion of said first and second terminals in said base, when said actuator of said pushbutton switch is in said normally closed position;

attaching said cover to said base; and sealing a bottom surface of said base adjacent to said cover and said terminals extending from the bottom of said base.

7. The method as recited in claim 6 wherein said step of maintaining said actuator in a normally closed position comprises the step of providing a spring positioned between said head portion of said actuator and a side of said cover.

8. The method as recited in claim 6 wherein said step of making a seal between said actuator and said cover comprises the step of providing an O-ring within said annular groove.

9. The method as recited in claim 6 wherein said step of sealing a bottom surface of said base comprises the step of using an epoxy to accomplish said sealing.

10. The method as recited in claim 9 wherein said step of using said epoxy comprises the step of placing said epoxy between said base and said cover and around said terminals extending from said base.

11. A pushbutton switch, sealed when in a normally closed position, comprising:

a cover having an opening in one side of said cover;

an actuator having a shaft portion and a head portion, said shaft portion extending through said opening in said side of said cover, said shaft having an annular groove adjacent to said head portion;

a spring positioned between said head portion of said actuator and a side of said cover opposite said side with said opening for maintaining said actuator in a normally closed position;

a sealing ring disposed in said annular groove of said actuator for making a seal between said actuator and said cover, when said actuator of said pushbutton switch is in said normally closed position thereby minimizing the force required to move said actuator, said seal being opened when said actuator is moved into said cover causing said switch to enter an electrically opened position;

a base having first and second terminals inserted into channels on opposite sides of said base, said cover being attached to said base;

a contact spring disposed within said head portion of said actuator, a first end and a second end of said contact spring contacting a top portion of said first and second terminals in said base, when said actuator of said pushbutton switch is in said normally closed position; and a material for sealing a bottom surface of said base adjacent to said cover and said terminals extending from the bottom of said base.

12. The pushbutton switch as recited in claim 11 wherein said sealing material comprises an epoxy.

13. The pushbutton switch as recited in claim 12 wherein said epoxy seals between said base and said cover and around said terminals extending from said base.

* * * * *